US010260259B2

(12) United States Patent
Nagata et al.

(10) Patent No.: US 10,260,259 B2
(45) Date of Patent: Apr. 16, 2019

(54) DOOR HANDLE DEVICE FOR VEHICLE

(71) Applicant: AISIN SEIKI KABUSHIKI KAISHA, Kariya-shi, Aichi-ken (JP)

(72) Inventors: Koichi Nagata, Chiryu (JP); Nobukazu Araki, Hekinan (JP); Jun Hasegawa, Nagoya (JP); Kenji Kaneko, Toyota (JP); Isao Kobayashi, Okazaki (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 36 days.

(21) Appl. No.: 15/083,857

(22) Filed: Mar. 29, 2016

(65) Prior Publication Data

US 2016/0290019 A1 Oct. 6, 2016

(30) Foreign Application Priority Data

Mar. 30, 2015 (JP) ..... 2015-069374

(51) Int. Cl.

| | |
|---|---|
| ***E05B 3/00*** | (2006.01) |
| ***E05B 85/16*** | (2014.01) |
| ***E05B 77/06*** | (2014.01) |
| *E05B 77/04* | (2014.01) |
| *E05B 15/04* | (2006.01) |

(52) U.S. Cl.

CPC ..... *E05B 85/16* (2013.01); *E05B 77/06* (2013.01); *E05B 77/04* (2013.01); *E05B 2015/0458* (2013.01)

(58) Field of Classification Search

CPC ..... E05B 85/16; E05B 77/06; E05B 77/04; E05B 2015/0458

USPC ..... 292/336.3, DIG. 22, DIG. 65

See application file for complete search history.

(56) References Cited

U.S. PATENT DOCUMENTS

| | | | | |
|---|---|---|---|---|
| 5,092,642 A * | 3/1992 | Lindmayer | ..... | E05B 77/42 292/201 |
| 6,042,159 A * | 3/2000 | Spitzley | ..... | E05B 77/06 16/111.1 |
| 6,709,033 B2 * | 3/2004 | Jooss | ..... | E05B 77/06 16/412 |

(Continued)

FOREIGN PATENT DOCUMENTS

| | | |
|---|---|---|
| JP | 2008-156935 A | 7/2008 |
| JP | 2008-156936 A | 7/2008 |

(Continued)

*Primary Examiner* — Kristina R Fulton
*Assistant Examiner* — Faria F Ahmad
(74) *Attorney, Agent, or Firm* — Buchanan Ingersoll & Rooney PC

(57) ABSTRACT

A door handle device for a vehicle includes a door opening prevention mechanism that is provided with an inertia lever being rotatably supported at a base frame, an inertia body being mounted to the inertia lever, and an elastic member elastically biasing the inertia lever toward an initial position where the movement of a link mechanism is not restricted by the inertia lever. The inertia lever includes a center of gravity of the inertia lever being set at a same position as a position of a center of gravity of the outside handle in an extending direction of the outside handle, the center of gravity of the inertia lever being set at a same position as a position of the center of gravity of the outside handle in vehicle upper-lower directions, or being set at a lower position relative to the center of gravity of the outside handle.

2 Claims, 11 Drawing Sheets

(56) References Cited

U.S. PATENT DOCUMENTS

| | | | | |
|---|---|---|---|---|
| 7,111,880 | B2 * | 9/2006 | Saitoh | E05B 77/04 292/336.3 |
| 7,152,893 | B2 * | 12/2006 | Pudney | E05B 13/002 292/336.3 |
| 7,677,614 | B2 * | 3/2010 | Monig | E05B 85/16 292/336.3 |
| 8,366,159 | B2 * | 2/2013 | Patel | E05B 77/06 292/203 |
| 9,062,477 | B2 * | 6/2015 | Da Deppo | E05B 77/06 |
| 9,163,436 | B2 * | 10/2015 | Nagata | E05B 77/06 |
| 9,404,292 | B2 * | 8/2016 | Da Deppo | E05B 77/06 |
| 9,637,954 | B2 * | 5/2017 | Nagata | E05B 77/06 |
| 2012/0074718 | A1 * | 3/2012 | Nagata | E05B 77/06 292/336.3 |
| 2016/0201354 | A1 * | 7/2016 | Lehner, Jr. | E05B 63/042 292/336.3 |

FOREIGN PATENT DOCUMENTS

| | | | |
|---|---|---|---|
| JP | 2009-243101 | A | 10/2009 |
| JP | 2009-243102 | A | 10/2009 |

* cited by examiner

DOOR HANDLE DEVICE FOR VEHICLE

CROSS REFERENCE TO RELATED APPLICATIONS

This application is based on and claims priority under 35 U.S.C. § 119 to Japanese Patent Application 2015-069374, filed on Mar. 30, 2015, the entire content of which is incorporated herein by reference.

TECHNICAL FIELD

This disclosure generally relates to a door handle device for a vehicle.

BACKGROUND DISCUSSION

A known door handle device for a vehicle including an outside door handle is provided with a mechanism that prevents a vehicle door from opening by an inertia force applied when the vehicle is in a collision. An example of the door handle device is disclosed in JP2008-156935A (hereinafter referred to as Patent reference 1). According to the door handle device disclosed in Patent reference 1, an inertia stopper member rotating to an engagement position by the inertia force applied when the vehicle is in a collision prevents an engagement portion from moving by engaging with the engagement portion of the outside handle being associated with a door latch mechanism. As a result, because the door latch mechanism is prevented from switching from a locked state to an unlocked state by the movement of the outside handle to an outer side of the vehicle when the vehicle is in a collision, the vehicle door can be prevented from opening.

According to the door handle device disclosed in Patent reference 1, in a case where the outside handle moves to the outer side of the vehicle before the inertia stopper member is rotated by the inertia force applied when the vehicle is in a collision, the inertia stopper member may not be engaged with the engagement portion of the outside handle. Moreover, in a case where the inertia force is applied to the vehicle door again before the inertia stopper member is returned to an initial position after rotating to the engagement portion by the inertia force, the returning movement of the inertia stopper member does not meet a timing in which the engagement portion of the outside handle is prevented from moving. Accordingly, the inertia stopper member may not be engaged with the engagement portion of the outside handle. As such, in a case where the movement of the inertia stopper member delays when the vehicle is in a collision, the inertia stopper member may not be operated appropriately.

A need thus exists for a door handle device for a vehicle which is not susceptible to the drawback mentioned above.

SUMMARY

A door handle device for a vehicle includes a base frame being configured to be attached to a door outer panel of a vehicle door, an outside handle being mounted on the base frame so as to be oscillated between a door closed position and a door opened position, the outside handle extending along an outer surface of a vehicle body, a link mechanism converting a movement of the outside handle in a door opening direction, the movement oscillating from the door closed position to the door opened position, into a movement releasing a retention of the vehicle door in a closed state, and a door opening prevention mechanism preventing the vehicle door from opening by restricting a movement of the link mechanism and by preventing the movement releasing the retention of the vehicle door in the closed state when the vehicle receives an impact. The door opening prevention mechanism includes an inertia lever being rotatably supported at the base frame, an inertia body being mounted to the inertia lever, and an elastic member elastically biasing the inertia lever toward an initial position where the movement of the link mechanism is not restricted by the inertia lever. The inertia lever is retained at the initial position in response to an elastic biasing force of the elastic member in a case where the inertia lever is not applied with an inertia force applied toward an outer side of the vehicle when the vehicle receives an impact. The inertia lever rotates from the initial position to a restriction position where the inertia lever restricts the movement of the link mechanism against the elastic biasing force of the elastic member by using an inertia mass of the inertia body in a case where the inertia lever is applied with the inertia force applied toward the outer side of the vehicle when the vehicle receives an impact and in a case where the inertia force is greater than the elastic biasing force of the elastic member. The inertia lever includes a center of gravity of the inertia lever being set at a same position as a position of a center of gravity of the outside handle in the extending direction of the outside handle, the center of gravity of the inertia lever being set at a same position as a position of the center of gravity of the outside handle in vehicle upper-lower directions, or being set at a lower position relative to the center of gravity of the outside handle.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 1:
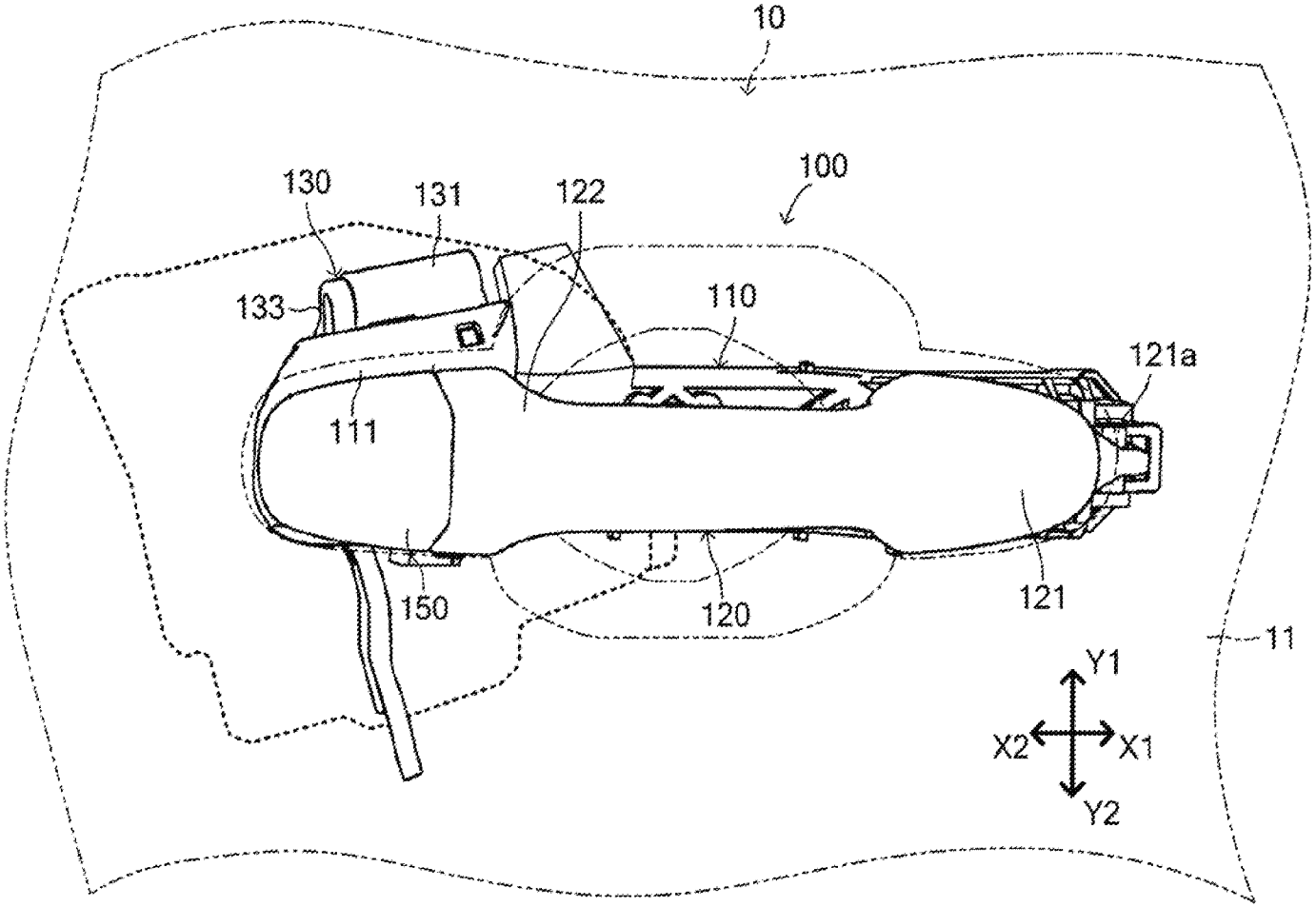
FIG. 1 is a side view of a door handle device for a vehicle according to an embodiment when seen from an outer side of the vehicle disclosed here.

Hereinafter, a door handle device for a vehicle according to an embodiment of this disclosure will be explained with reference to the drawings. In the drawings, a front and a rear of the vehicle are shown as an arrow X1 and an arrow X2, respectively. An upper and a lower of the vehicle are shown as an arrow Y1 and an arrow Y2, respectively. An inner side and an outer side of the vehicle are shown as an arrow Z1 and an arrow Z2, respectively. These directions can be applied to the door handle device for the vehicle before and after being mounted on a vehicle door.

A door handle device 100 for a vehicle (hereinafter, simply also referred to as a door handle device) according to the embodiment of this disclosure is mounted on a vehicle door 10. As shown in FIG. 1, plural components including a base frame 110 and an outside handle 120 are integrally assembled as an assembly (also referred to as assy).

The base frame 110 is a member extending longitudinally in the vehicle front-rear directions X1, X2 that are along an outer surface of a vehicle body. The base frame 110 is fixed at the vehicle inner side of a metal-made door outer panel 11 configuring the outer surface of the vehicle door 10. The base frame 110 serves as a feature retaining the outside handle 120 by being engaged with the outside handle 120. The base frame 110 is made from a resin material. A link mechanism 130, a door opening prevention mechanism 140 (see FIG. 2) and a cap 150 in addition to the outside handle 120 are mounted on the base frame 110. The cap 150 is mounted on an end portion 111 (a left end portion in FIG. 1) of the base frame 110 for preventing the outside handle 120 from being removed from the base frame 110, the end portion 111 that is provided at a rear side of the vehicle. The base frame 110 corresponds to a base frame of the disclosure.

The outside handle 120 is provided at the outer side of the vehicle of the vehicle door, and, similarly to the base frame 110, extends longitudinally in the vehicle front-rear directions X1, X2 that are along the outer surface of the vehicle body. The outside handle 120 serves as a grip-type operation handle (an outer handle) that includes a first end and a second end. The outside handle is made from the resin material. A user can perform opening and closing operations of the vehicle door by grasping the outside handle 120. The outside handle 120 corresponds to an outside handle for a vehicle of this disclosure.

The outside handle 120 is mounted on the base frame 110 so as to be oscillated about a handle shaft portion 121*a* being provided at an end portion (a right end portion in FIG. 1) positioned at a front side of the vehicle between a door closed position (an initial position) shown in FIG. 1 and a door opened position in which the outside handle 120 rotates to the outer side of the vehicle by a predetermined amount. Thus, an operation in a door opening direction and an operation in a door closing direction are available, the door opening operation oscillating the outside handle 120 from the door closed position to the door opened position, the door closing operation oscillating the outside handle 120 from the door opened position to the door closed position. The outside handle 120 is engaged with a bell crank 131 that corresponds to a component of the link mechanism 130 at an engagement portion (an engagement portion 122*a* in FIG. 2) that is provided at an end portion (a left end portion in FIG. 1) of the rear side of the vehicle.

The link mechanism 130 converts the operation in the door opening direction, the operation oscillating the outside handle 120 from the door closed position to the door opened position, into an unlatched operation (an operation shifting from a latched state to an unlatched state) of a door latch mechanism that can retain the vehicle door 10 in a closed state relative to the vehicle body. For this purpose, the link mechanism 130 includes an element, for example, a coil spring (a coil spring 132 in FIG. 2) and a connection lever 133 in addition to the bell crank 131. The door latch mechanism includes a known structure and is provided with a striker fixed at the vehicle body, and a latch and a pawl being mounted on the vehicle 10. A latch mechanism 10 disclosed in JP2013-130028A is referred for details of the door latch mechanism. In the latched state of the door latch mechanism, because the latch that is engaged with the striker is restricted from rotating by the pawl, the door opening operation opening the vehicle door 10 that is in the closed state is unavailable. On the other hand, in the unlatched state of the door latch mechanism, because the latch that is engaged with the striker is not restricted from rotating by the pawl, the door opening operation of the vehicle door 10 is available. The link mechanism 130 corresponds to a link mechanism of this disclosure.

Figure 2:
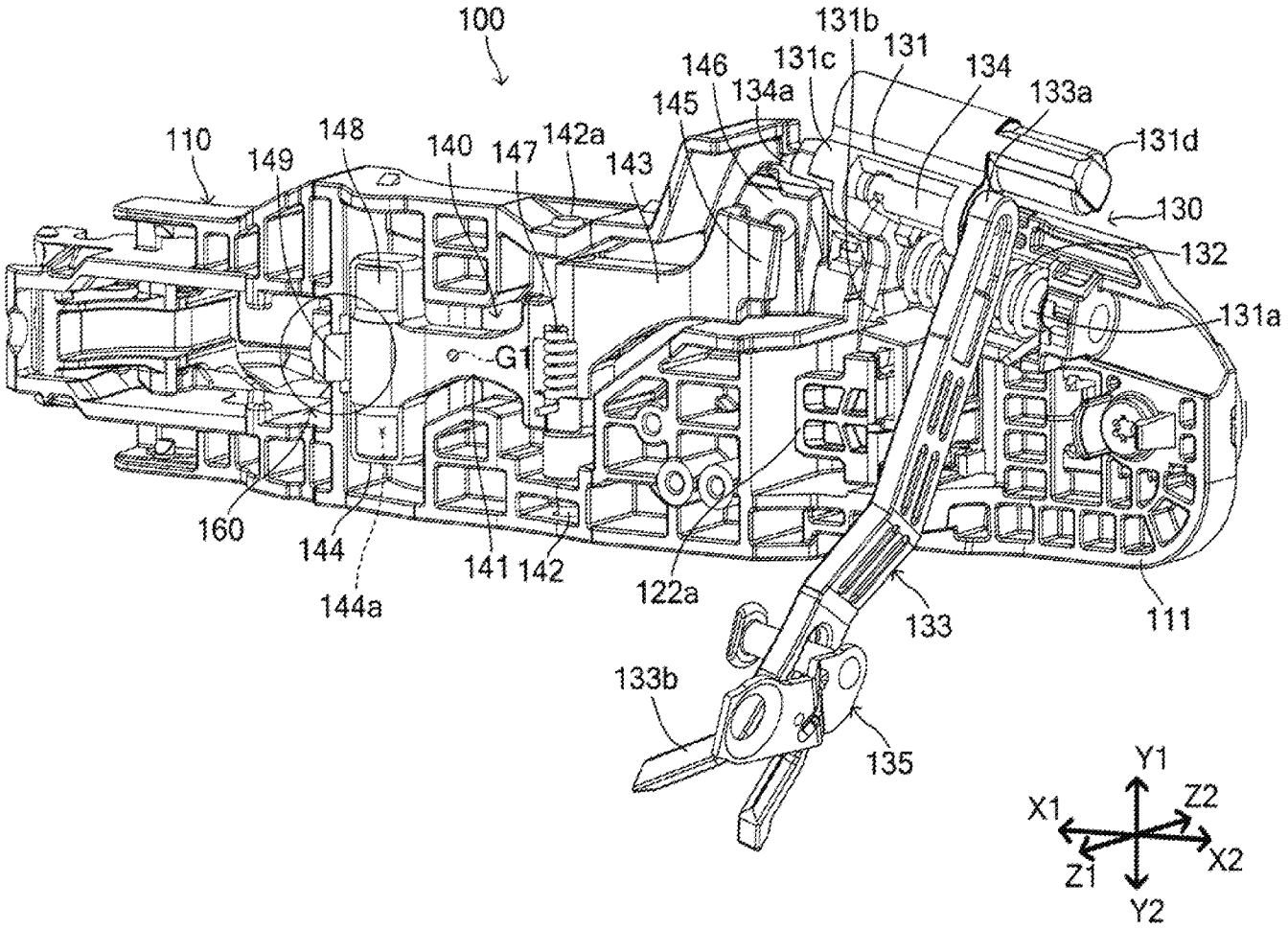
FIG. 2 is a perspective view of the door handle device for the vehicle in a state where a protection cover is removed when seen from an inner side of the vehicle.

As shown in FIG. 2, the bell crank 131 is rotatably mounted on the base frame 110 at a cylindrical shaft portion 131*a* extending along the vehicle front-rear directions X1, X2 in a state where the vehicle door 10 is closed. The bell clank 131 includes an input arm portion 131*b* and an output arm portion 131*c*. The input arm portion 131*b* extends downwardly of the vehicle. An extending end portion of the input arm portion 131*b* is engaged with (in contact with) a portion of the engagement portion 122*a* of the outside handle 120, the portion that is disposed at the outer side of the vehicle. The output arm portion 131*c* is integrally connected to an upper end portion 133*a* of the connection lever 133 via a cylindrical connection shaft 134 (i.e., serving as an operation member). Alternatively, the connection lever 133 and the connection shaft 134 may be integrally configured. The bell crank 131 includes a counterweight 131*d* (an inertia portion). The counterweight 131*d* is for restricting the outside handle 120 from operating the opening operation by the inertia force applied toward the outer side of the vehicle. The restriction force is set by the mass (the weight) of the counterweight 131*d* and a biasing force of the coil spring 132.

The coil spring 132 serves as a return spring (a member automatically returning the outside handle 120 from the door opening operation to the door closing operation) that elastically biases the bell crank 131 and the outside handle 120 towards the door closed position (the initial position) in FIG. 2. The coil spring 132 is mounted on an outer circumference of an axis of the shaft portion 131*a* that is provided at the bell crank 131. A first end portion of the coil spring 132 is engaged with the base frame 110, and a second end portion of the coil spring 132 is engaged with the bell crank 131. Thus, the bell crank 131 is rotationally biased by the coil spring 132 with a predetermined elastic biasing force in a direction where the input arm portion 131*b* of the bell crank 131 is engaged with the engagement portion 122*a* of the outside handle 120. The input arm portion 131*b* is elastically engaged with the engagement portion 122*a* of the outside handle 120.

A distal end of a lower end portion 133*b* of the connection lever 133 is formed in a Y-shape. The distal end of the lower end portion 133*b* is engaged with the outside open lever 135. The outside open lever 135 is linked with a pawl of the door latch mechanism. In a case where the bell crank 131 rotates by a predetermined amount against the elastic biasing force of the coil spring 132 because the outside handle 120 is operated from the door closed position to the door opened position, the connection lever 133 moves downwardly by a predetermined amount from the initial position shown in FIG. 2.

The connection shaft 134 is rotatably mounted on the output arm portion 131*c* of the bell crank 131, and is rotatable with the bell crank 131. Thus, in a case where the outside handle 120 moves in the door opening direction from the door closed position to the door opened position, the connection shaft 134 and the connection lever 133 are driven to move downwardly by the bell crank 131. Accordingly, the unlatch operation of the door latch mechanism by the connection lever 133 is available. An end portion of the connection shaft 134, the end portion that is disposed at the front side of the vehicle, includes a cone-shaped engagement portion 134*a* that is tapered toward a distal end.

According to the aforementioned link mechanism 130, in a case where the outside handle 120 is positioned at the door closed position in a state where the vehicle door 10 is closed, and in a case where the connection lever 133 is positioned at the initial position, the door latch mechanism comes to be in the latched state, and the aforementioned door opening operation of the vehicle door 10 is not available. On the other hand, in a case where the outside handle 120 is operated from the door closed position to the door opened position, and in a case where the connection lever 133 moves downwardly by the predetermined amount from the initial position, the door latch mechanism comes to be in the unlatched state, and the aforementioned door opening operation of the vehicle door 10 is available.

The door opening prevention mechanism 140 is provided at the front side of the vehicle of the base frame 110 relative to the link mechanism 130. In a case where the inertia force is applied to the outer side Z2 of the vehicle by an impact load applied to the vehicle door 10 when the vehicle receives an impact, or when the vehicle is in a collision (especially, when the side of the vehicle collides) in a state where the vehicle door 10 is closed, the door opening prevention mechanism 140 restricts the movement of the link mechanism 130, specifically, the movement moving the connection shaft 134 downwardly of the vehicle (in the door opening direction). Accordingly, the door opening prevention mechanism 140 prevents the vehicle door 10 from opening. For this purpose, the door opening prevention mechanism 140 includes an inertia lever 141 and a coil spring 147 (i.e., serving as an elastic member). The door opening prevention mechanism 140 corresponds to a door opening prevention mechanism of the disclosure.

The inertia lever 141 is a resin member extending along the vehicle front-rear directions X1, X2, and includes a support shaft portion 142, a first arm portion 143, and a second arm portion 144. The inertia lever 141 is rotatably (also referred to as the oscillation) mounted on the base frame 110 at the support shaft portion 142 by an attachment pin 142*a*. Thus, the inertia lever 141 is rotatable about the support shaft portion 142 between the initial position shown in FIG. 2 (An initial position P1 in FIG. 3) and a restriction position (a restriction position P2 shown with two-dotted line in FIG. 3) for restricting the connection shaft 134 from moving downwardly of the vehicle. The inertia lever 141 corresponds to an inertia lever of the disclosure.

The coil spring 147 is provided between the support shaft portion 142 and the base frame 110. The coil spring 147 normally elastically biases the inertia lever 141 towards the initial position P1 where the movement of the connection shaft 134 of the link mechanism 130 is not restricted, that is, in the anti-clockwise direction when seen from the upper side of the vehicle. The coil spring 147 corresponds to an elastic member of this disclosure.

Thus, in a case where the inertia lever 141 is not applied with the inertia force applied toward the outer side Z2 of the vehicle, the inertia lever 141 is retained at the initial position P1 in response to the elastic biasing force of the coil spring 147. On the other hand, in a case where the inertia lever 141 is applied with the inertia force that is greater than the elastic biasing force of the coil spring 147 to the outer side Z2 of the vehicle, the inertia lever 141 rotates from the initial position P1 to the restriction position P2 against the elastic biasing force of the coil spring 147.

The first arm portion 143 serves as an arm portion extending from the support shaft portion 142 to the rear side of the vehicle (the rear direction X2). The first arm portion 143 corresponds to a first arm portion of this disclosure. An extending end of the first arm portion 143 includes a first engagement piece 145 and a second engagement piece 146 that are away from each other in the inner-outer directions Z1, Z2 of the vehicle and that extend in the vehicle front-rear directions. The first engagement piece 145 of the first arm portion 143 is provided inner side of the vehicle relative to the second engagement piece 146.

The second arm portion 144 serves as an arm portion extending from the support shaft portion 142 to the front side of the vehicle (the front direction X1). The second arm portion 144 corresponds to a second arm portion of this disclosure. A recessed housing space 144*a* being provided at an extending end range of the second arm portion 144 is provided with a metal-made counterweight 148 (i.e., serving as an inertia body). The extending end range of the second arm portion 144 corresponds to an end portion of the inertia lever 141 at the front side of the vehicle. The counterweight 148 corresponds to an inertia body of this disclosure. Thus, the position of a center of gravity G1 of the inertia lever 141 can be set at the front side of the vehicle (close to the counterweight 148) in the vehicle front-rear directions relative to the support shaft portion 142.

Figure 3:
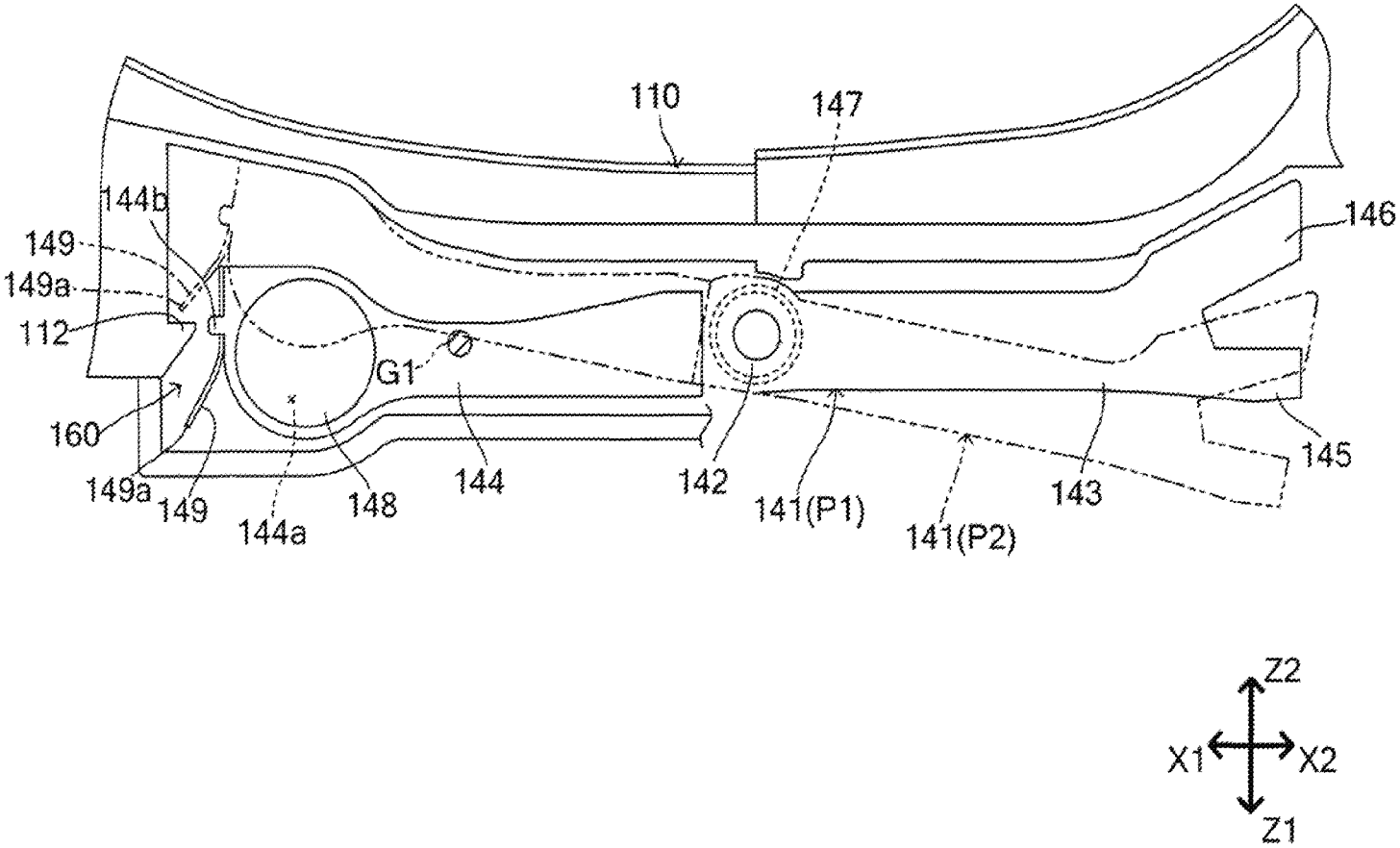
FIG. 3 a view of an inertia lever when seen from an upper side of the vehicle.

The second arm portion 144 is provided with a retaining mechanism 160 for retaining the inertia lever 141 that has rotated from the initial position P1 to the restriction position P2 at the restriction position P2. The retaining mechanism 160 corresponds to a retaining mechanism of this disclosure. As shown in FIG. 3, the retaining mechanism 160 includes an engagement protrusion 112 and a plate spring (a plate-shaped spring member) 149. The engagement protrusion 112 is protrudingly provided at the base frame 110 so as to face the second arm portion 144 of the inertia lever 141. The plate spring 149 is provided at the extending end range (a fixed portion 144*b*) of the second arm portion 144 at the front side of the vehicle. In a case where the inertia lever 141 rotates to the restriction position P2, the plate spring 149 is elastically deformed by being pressed to the engagement protrusion 112 and is locked and retained by the engagement protrusion 112 by passing through the engagement protrusion 112 and by being returned to an original shape. Thus, the restriction position P2 serves as a lock position where the plate spring 149 is locked by the engagement protrusion 112. The engagement protrusion 112 and the plate spring 149 correspond to an engagement protrusion and a plate spring of this disclosure, respectively.

Figure 4:
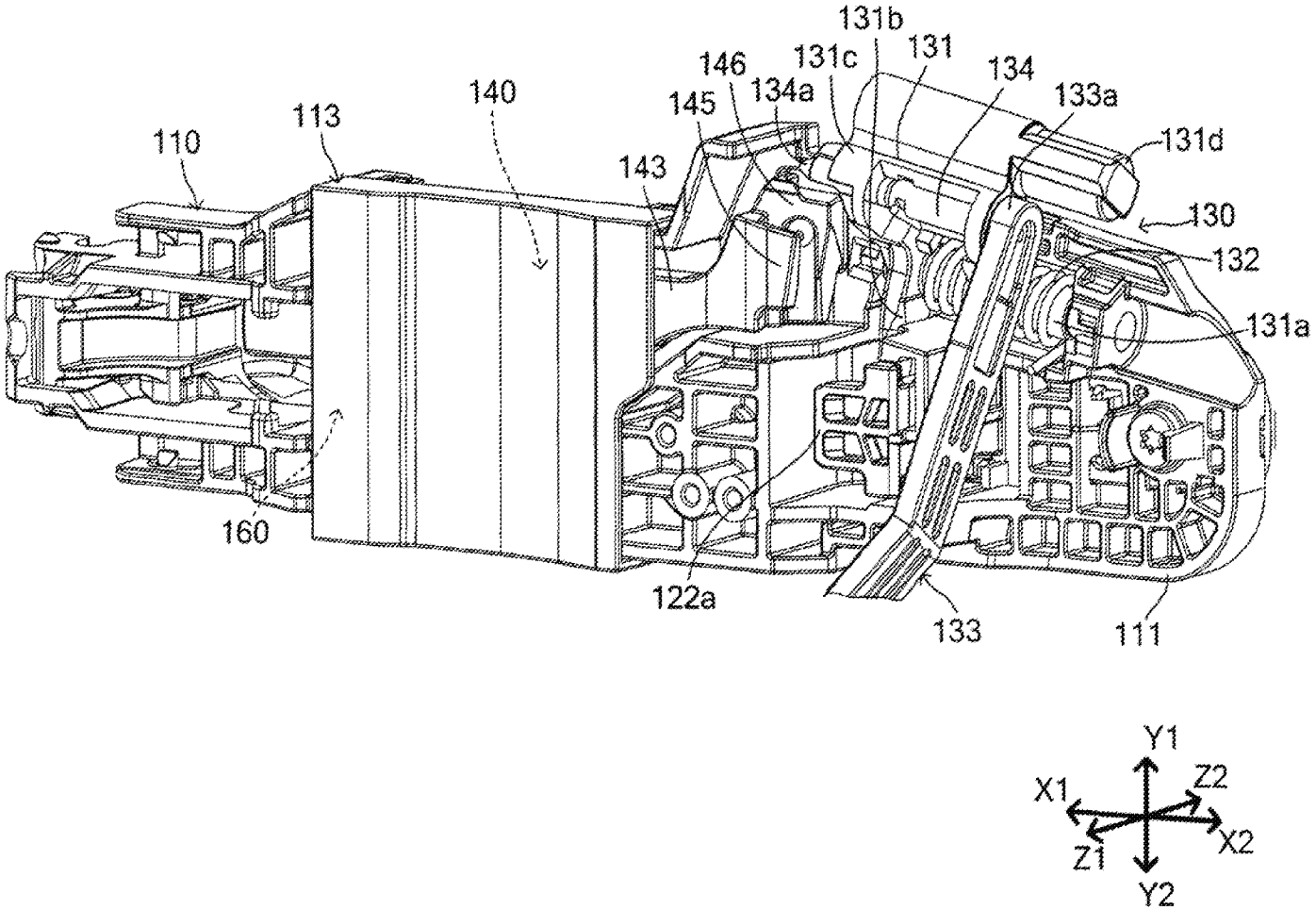
FIG. 4 is a perspective view of the door handle device for the vehicle in a state where the protection cover is provided when seen from the inner side of the vehicle.

As shown in FIG. 4, a protection cover 113 is provided at the base frame 110 for covering the door opening prevention mechanism 140 and the retaining mechanism 160 from the inner side of the vehicle. The protection cover 113 serves as a cover member for preventing the inertia lever 141 from being retained at the restriction position (the restriction position P2 in FIG. 3) by the retaining mechanism 160 because an assembly person may press the inertia lever 141, and may rotate the inertia lever 141 to the restriction position P2. The protection cover 113 corresponds to a protection cover of this disclosure.

The protection cover 113 may cover the whole door opening prevention mechanism 140, or may cover a part of the door opening prevention mechanism 140. Accordingly, in a state where the inertia lever 141 is mounted on the base frame 110, the inertia lever 14 can be prevented from being retained at the restriction position P2 by the retaining mechanism 160 because an assembly person may press the inertia lever 141, and may rotate the inertia lever 141 to the restriction position P2. Specifically, in a case where the protection cover 113 covers only a range from the supporting shaft portion 142 to the second arm portion 144 of the inertia lever 141, the protection cover 113 is downsized and comes to be light in weight to have the door handle device 100 be downsized and come to be light in weight. On the other hand, because a range (for example, the first arm portion 143) of the inertia lever 141, the range that is provided at the rear side of the vehicle relative to the supporting shaft portion 142, does not rotate even though an assembly person presses the inertia lever 141, the range of the inertia lever 141 does not have to be covered.

Hereinafter, the respective operations of the door opening prevention mechanism 140 and of the retaining mechanism 160 will be explained with reference to FIGS. 5 to 9.

Figure 5:
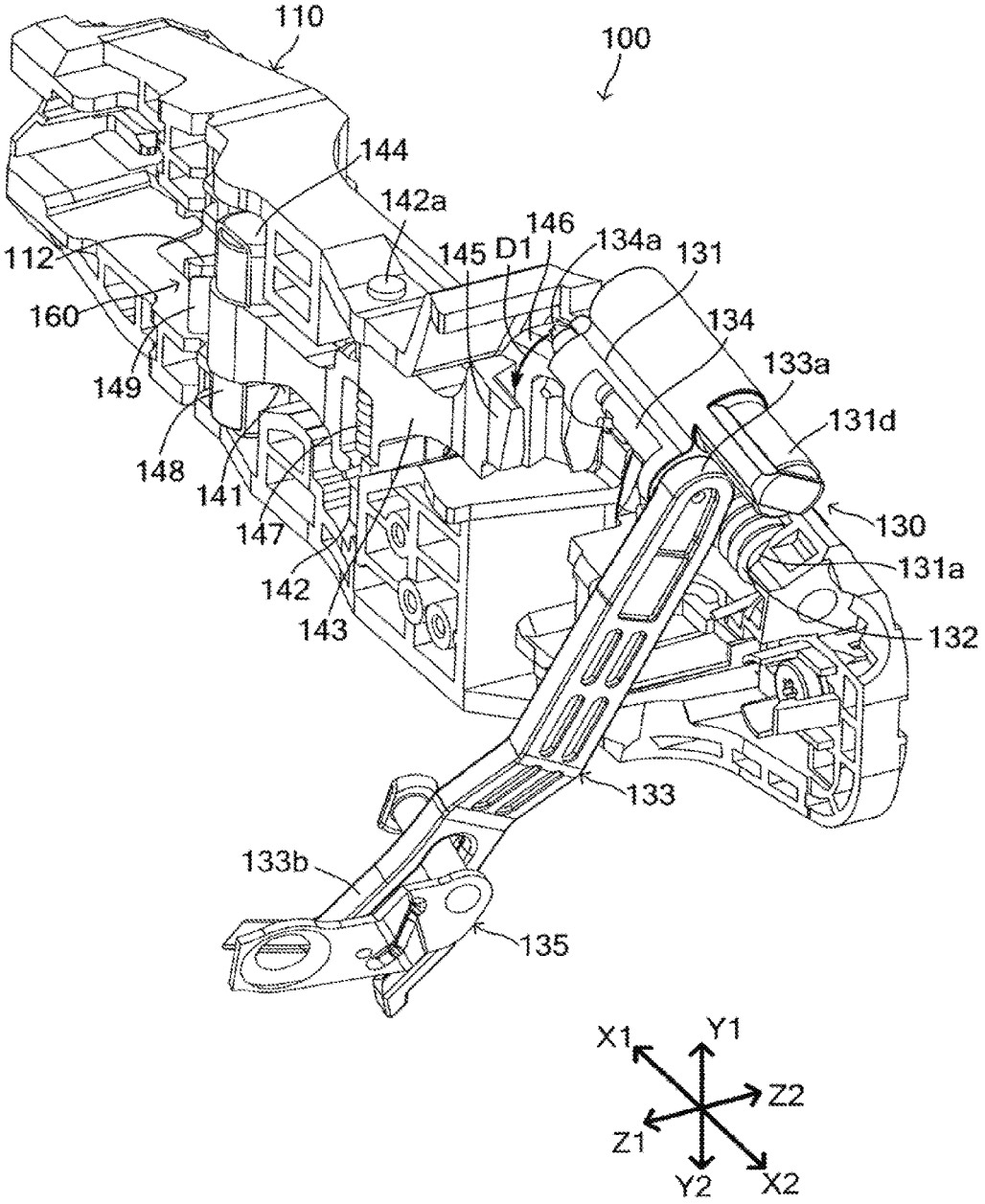
FIG. 5 is a perspective view illustrating the inertia lever that is disposed at an initial position.
Figure 6:
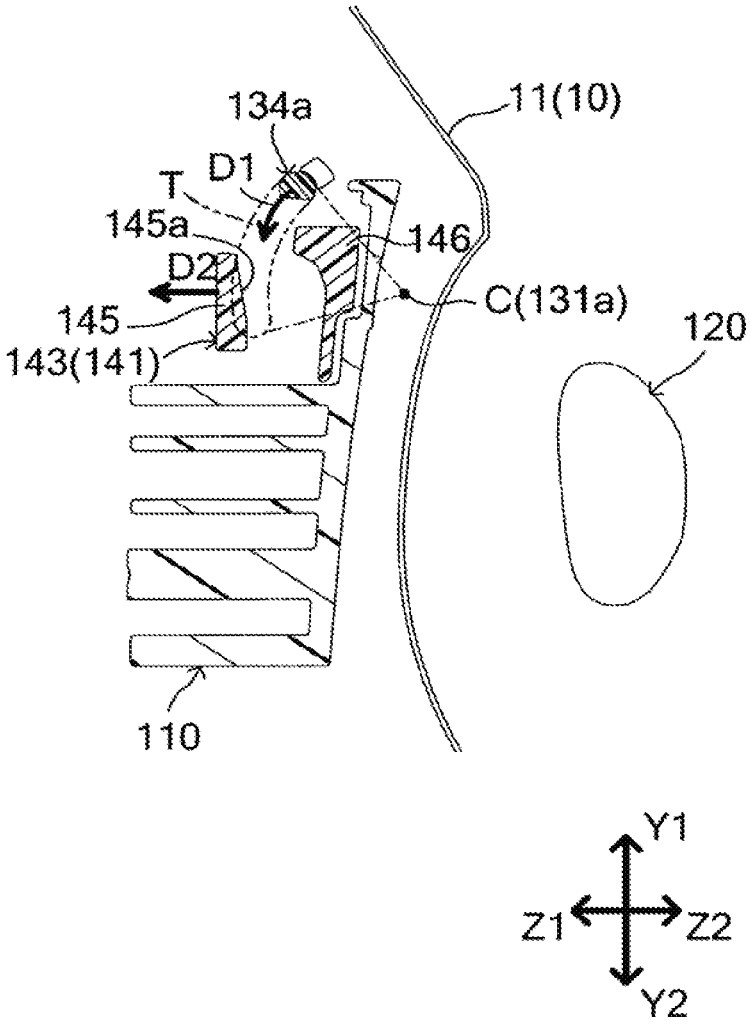
FIG. 6 is a view illustrating a cross sectional structure of a distal end of a first arm portion of the inertia lever in FIG. 5.

In a case where the inertia lever 141 is not applied with the inertia force applied toward the outer side Z2 of the vehicle when the vehicle receives an impact, the inertia lever 141 is retained at the initial position in FIG. 5 in response to the elastic biasing force of the coil spring 147. At this time, as shown in FIG. 6, the first engagement piece 145 of the first arm portion 143 of the inertia lever 141 is positioned on a movement trace of the connection shaft 134 rotating about a rotational axis C (the shaft portion 131*a* of the bell crank 131), especially on a movement trace T (a range shown with a two-dotted line in FIG. 6) of the engagement portion 134*a*. Specifically, the first engagement piece 145 of the first arm portion 143 includes an engagement surface 145*a* that is provided at the outer side of the vehicle. In a case where the inertia lever 141 is positioned at the initial position, the engagement surface 145*a* faces the second engagement piece 146 and extends along the movement trace T. Only the engagement surface 145*a* is positioned on the movement trace T and an outer surface other than the engagement surface 145*a* is out of the movement trace T. Meanwhile, in a case where the inertia lever 141 is positioned at the initial position, the second engagement piece 146 of the first arm portion 143 is positioned at a position out of the movement trace T of the engagement portion 134*a* of the connection shaft 134.

In a case where the engagement portion 134*a* of the connection shaft 134 moves on the movement trace T in a direction of an arrow D1 in FIG. 6 in response to the movement of the outside handle 120 rotating from the door closed position to the door opened position when the normal operation is performed, the engagement portion 134*a* of the connection shaft 134 engages only with the engagement surface 145*a* of the first engagement piece 145 and slides on the engagement surface 145*a*. Because the first engagement piece 145 is pressed in a direction of an arrow D2 in FIG. 6 and is pressed out of the movement trace T, the respective movements of the connection shaft 134 and of the connection lever 133 in the door opening direction is allowed. At this time, the inertia lever 141 rotates by a predetermined amount against the elastic biasing force of the coil spring 147, however, the inertia lever 141 rotates slightly, and does not reach the restriction position P2. According to the embodiment, because the inertia lever 141 always rotates by a predetermined amount in response to the normal operation of the outside handle 120, the rotation portion of the inertia lever 141 that is positioned at the initial position is prevented from being attached and fixed with dust and dirt. As a result, the appropriate operation of the inertia lever 141 is maintained for a long time.

Figure 7:
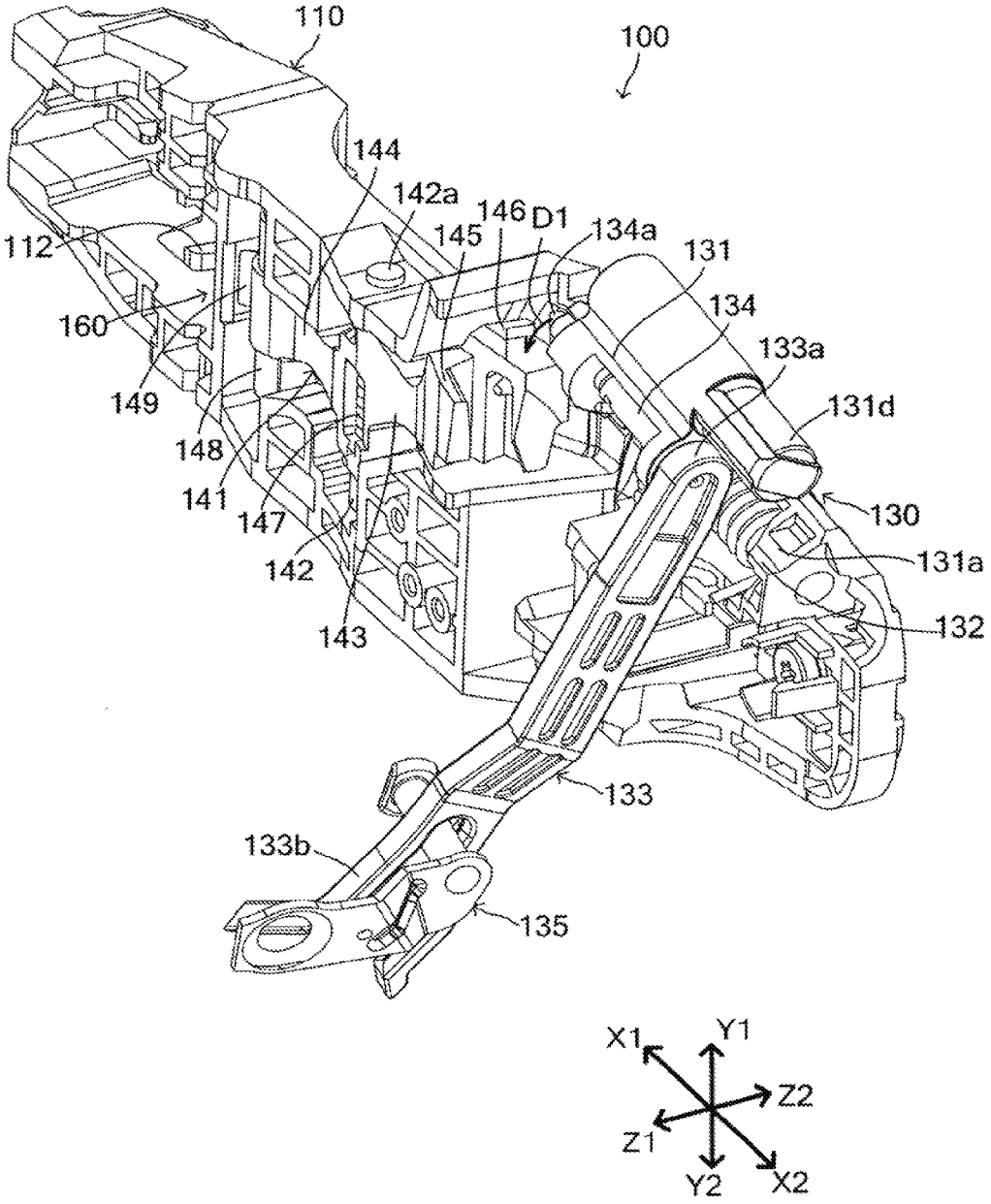
FIG. 7 is a perspective view illustrating the inertia lever that is disposed at a restriction position.
Figure 8:
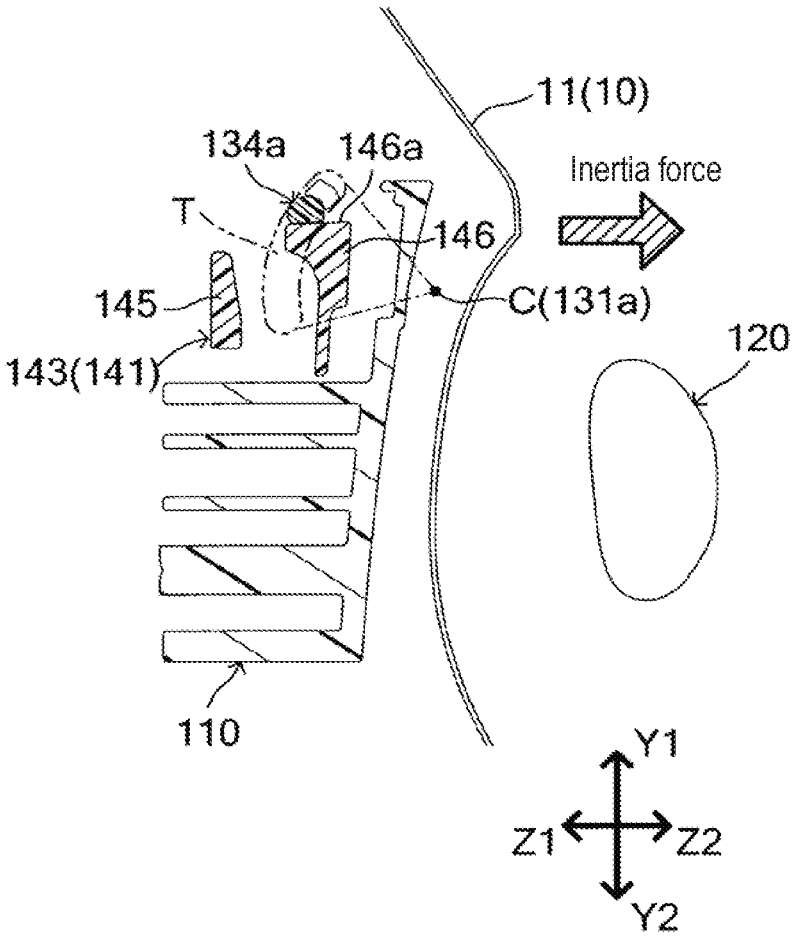
FIG. 8 is a view illustrating the cross sectional structure of the distal end of the first arm portion of the inertia lever in FIG. 7.

On the other hand, in a case where the inertia lever 141 is applied with the inertia force applied toward the outer side Z2 of the vehicle when the vehicle receives an impact, and in a case where the inertia force is greater than the elastic biasing force of the coil spring 147, the inertia lever 141 is set at the restriction position P2 in FIG. 7 against the elastic biasing force of the coil spring 147 by using an inertia mass (weight) of the counterweight 148. At this time, as shown in FIG. 8, the second engagement piece 146 of the first arm portion 143 of the inertia lever 141 is positioned on the movement trace T of the engagement portion 134*a* of the connection shaft 134 (the operation member configuring the link mechanism 130). Specifically, the second engagement piece 146 of the first arm portion 143 includes an engagement surface (an upper surface) 146*a*, and in a case where the inertia lever 141 is positioned at the restriction position P2, the engagement surface 146*a* comes to be positioned on the movement trace T and extends in the vehicle inner and outer directions Z1, Z2 so as to be intersected with the movement trace T. On the other hand, in a case where the inertia lever 141 is positioned at the restriction position P2, the first engagement piece 145 of the first arm portion 143 is positioned at a position out of the movement trace T of the engagement portion 134*a* of the connection shaft 134.

In a state where the inertia lever 141 is set at the restriction position P2, as shown in FIG. 8, the engagement portion 134*a* of the connection shaft 134 comes in contact with the engagement surface 146*a* of the second engagement piece 146 at an initial movement moving on the movement trace T in the direction of the arrow D1 (see FIG. 6). Accordingly, the inertia lever 141 can restrict the movement of the connection shaft 134 at the second engagement piece 146 of the first arm portion 143 when the vehicle receives an impact. At this time, because the movement of the engagement portion 134*a* of the connection shaft 134 is prevented by the second engagement piece 146, and because the movement of the connection lever 133 in the door opening direction is restricted, the outside handle 120 cannot rotate to the door opened position. As a result, the movement of the connection lever 133 in the door opening direction can be restricted by the inertia lever 141 that is provided at the restriction position P2 when the vehicle receives an impact, and the inertia lever 141 can prevent the unlatched movement (a movement that shifts from a state where the vehicle door is closed (the latched state) to a state where the vehicle door can be opened (the unlatched state)) of the door latch mechanism.

Figure 9:
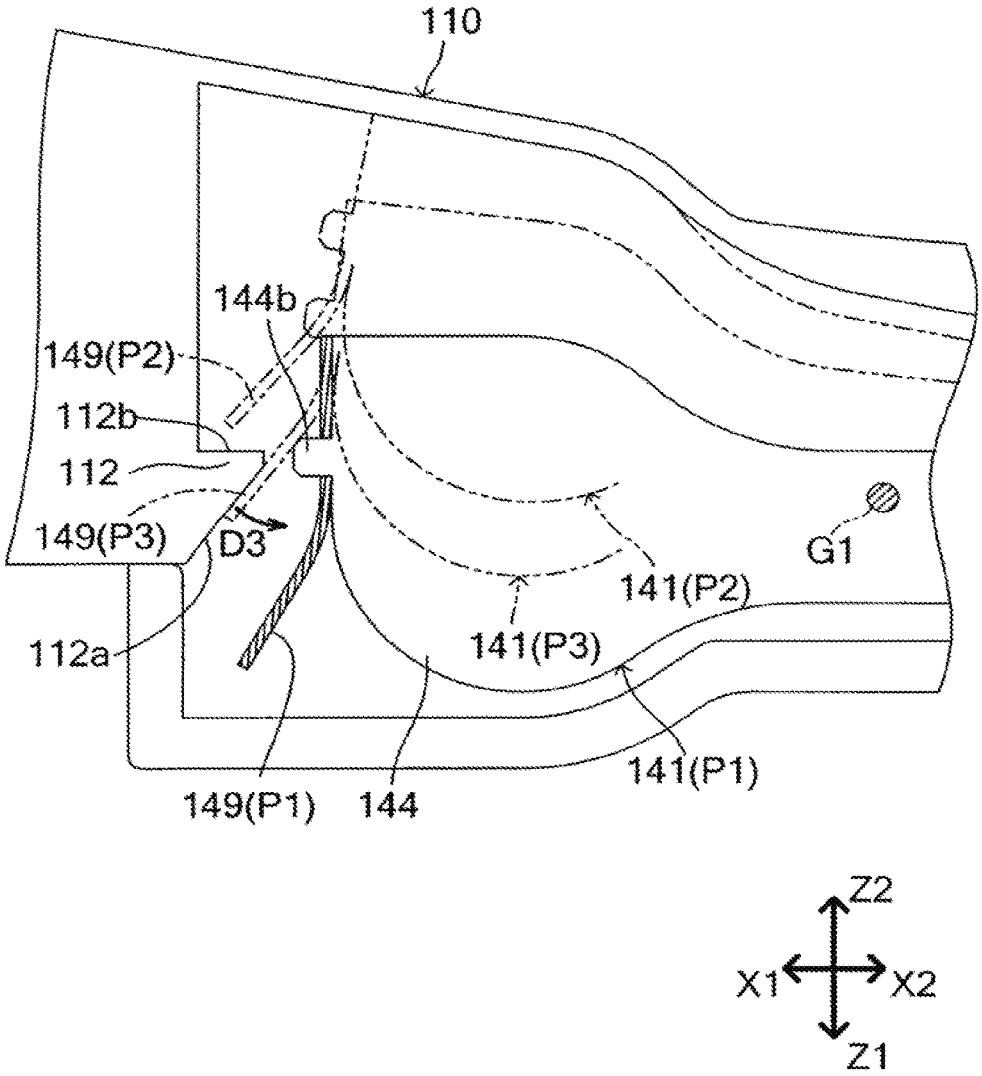
FIG. 9 is a view illustrating a cross sectional structure of a second arm portion of the inertia lever.

As shown in FIG. 9, in a case where the inertia lever 141 rotates from the initial position P1 to the restriction position P2 by the inertia force applied toward the outer side Z2 of the vehicle, the plate spring 149 comes in contact with the engagement protrusion 112 of the base frame 110 at an engagement position P3 that is positioned between the initial position P1 and the restriction position P2. The engagement protrusion 112 includes an inclined plane 112*a* at a contact portion (a facing wall portion provided at the inner side of the vehicle) relative to the plate spring 149, the inclined place 112*a* extending along an extending direction of the plate spring 149. Thus, the plate spring 149 is smoothly engaged with the engagement protrusion 112 by coming in surface-contact with the inclination surface 112*a* of the engagement protrusion 112. Because the inertia lever 141 rotates from the engagement position P3 to the outer side Z2 of the vehicle by the inertia force, the plate spring 149 is pressed by the engagement protrusion 112 and passes through the engagement protrusion 112 in an elastically deformed state in the direction of the arrow D3 relative to the fixing portion 144*b*. In the end, the inertia lever 141 rotates up to the restriction position P2 by the inertia force.

Because the counterweight 148 is provided at the extending end range of the second arm portion 144, the inertia lever 141 can be rotated sensitively by the inertia force applied when the vehicle receives an impact. Because the inertia load applied to the counterweight 148 can be used to elastically deform the plate spring 149, the plate spring 149 can be securely elastically deformed when being engaged with the engagement protrusion 112. Moreover, because the plate spring 149 is provided at the extending end range of the second arm portion 144, the range of the movement of the plate spring 149 can be increased (an operation stroke can be enlarged) when the inertia lever 141 is operated. As a result, the engagement structure in which the plate spring 149 is easily engaged with the engagement protrusion 112 can be achieved without complexing the structure of the base frame 110. Because the plate spring 149 is provided at the extending end range of the second arm portion 144, the movement of the inertia lever 141 is not easily disturbed by the plate spring 149.

Because the inertia lever 141 rotates up to the restriction position P2, the engagement of the plate spring 149 relative to the engagement protrusion 112 is released at the restriction position P2, and is returned to the original shape (the initial state). The engagement protrusion 112 includes a vertical surface 112*b* at a portion (an opposing wall portion that is provided at the outer side of the vehicle) opposing to the contact portion, the vertical surface 112*b* intersecting with the extending direction of the plate spring 149 and extending in the vehicle front-rear directions X1, X2. Thus, the movement of the inertia lever 141 that is returned from the restriction position P2 toward the initial position P1 is prevented by a spring end 149*a* (see FIG. 3) of the plate spring 149, the spring end 149*a* that is disturbed or trapped by the engagement protrusion 112. On the other hand, the movement of the inertia lever 141 rotating from the restriction position P2 in the opposing direction relative to the initial position P1 is prevented by the second arm portion 144 that comes in contact with the wall surface of the base frame 110. Thus, the retaining mechanism 160 can securely retains the inertia lever 141 at the restriction position P2.

Meanwhile, in a case where the aforementioned inertia lever 141 is used, and in a case where the outside handle 120 moves to the outer side Z2 of the vehicle before the inertia lever 141 rotates up to the restriction position P2 by the inertia force applied when the vehicle receives an impact, the inertia lever 141 may not be able to engage with the engagement portion 134*a* of the connection shaft 134. As such, because the movement of the inertia lever 141 when the vehicle receives an impact delays, the inertia lever 141 may not operate appropriately.

Figure 10:
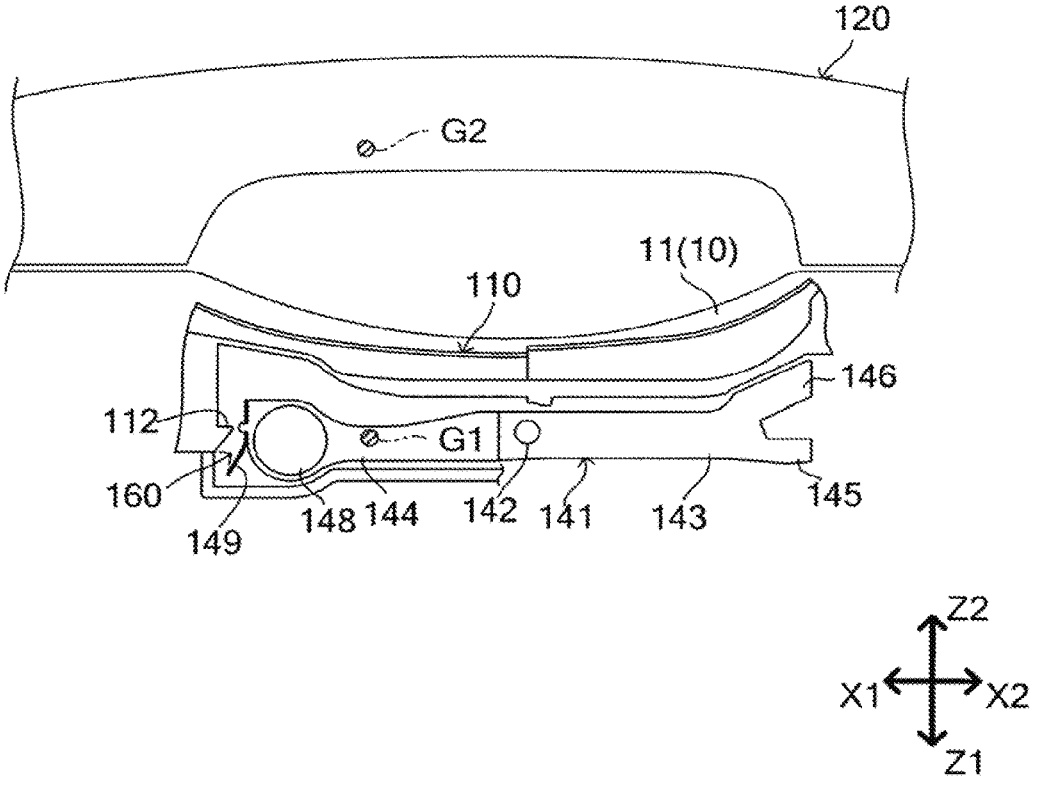
FIG. 10 is a view illustrating a positional relationship between a center of gravity of an inertia lever of the inertial lever and a center of gravity of an outside handle in vehicle front-rear directions.
Figure 11:
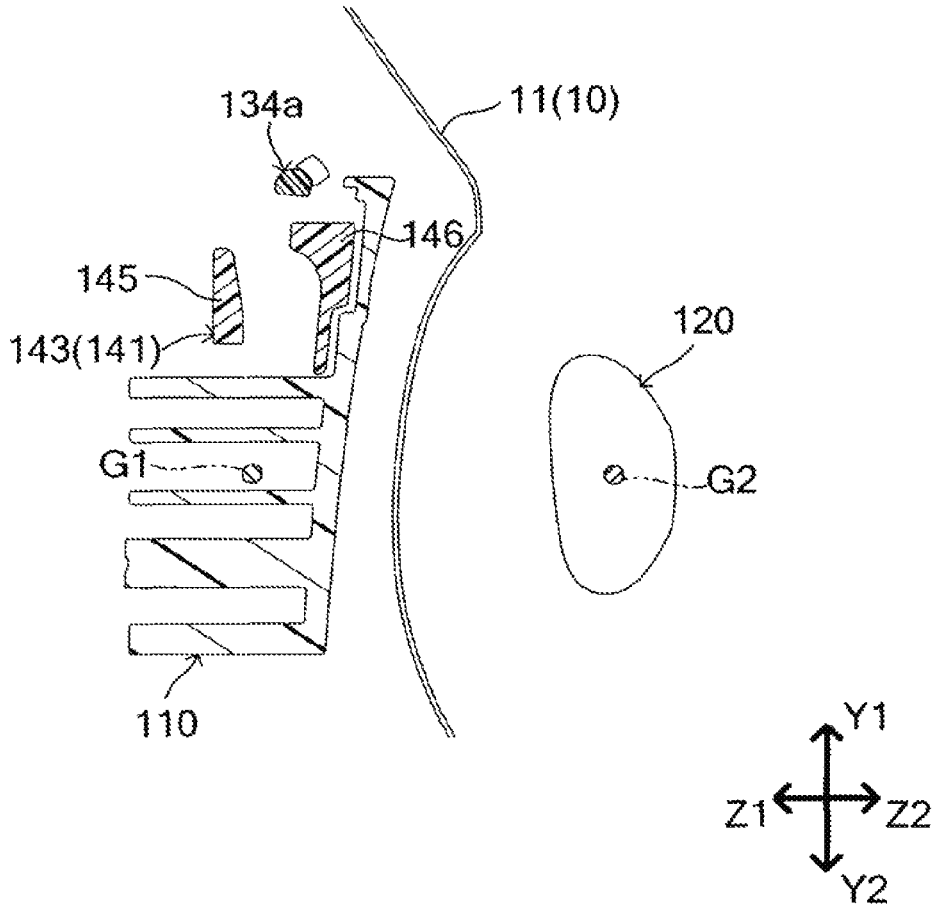
FIG. 11 is a view illustrating a positional relationship between the center of gravity of the inertia lever and the center gravity of the handle of the outside handle in vehicle upper-lower directions.

Thus, according to the door opening prevention mechanism 140 of the embodiment, the positional relationship of the center of gravity G1 of the inertia lever 141 and the center of gravity G2 of the outside handle 120 is set in a specific state so that the inertia lever 141 is prevented from moving later than the movement of the outside handle 120 when the vehicle receives an impact. Specifically, the positional relationship is shown in FIGS. 10 and 11. That is, according to the embodiment, as a first setting of the center of gravity, the center of gravity G1 of the inertia lever 141 is set at the same position (in the front-rear directions) of a center of gravity G2 of the outside handle 120 in the vehicle front-rear directions X1, X2 that corresponds to the extending direction of the handle (see FIG. 10). Moreover, as a second setting of the center of gravity, the center of gravity G1 of the inertia lever 141 is set at the same position (in the upper-lower directions) of the center of gravity G2 of the outside handle 120 in the vehicle upper-lower directions Y1, Y2 (see FIG. 11).

According to a door handle device that is provided at a vehicle door being mounted on a side portion (a side surface) of a vehicle, as the first setting of the center of gravity, the center of gravity G1 of the inertia lever 141 is set at the same position of the center of gravity G2 of the outside handle 120 in the front-rear directions that correspond to the extending direction of the door handle.

An impact load applied to the vehicle when the vehicle receives an impact is assumed to be transmitted from the front side of the vehicle to the vehicle door 10 and from the rear side of the vehicle to the vehicle door 10 in the vehicle front-rear directions X1, X2. In this case, in a case where the center of gravity G1 of the inertia lever 141 is positioned at the rear side of the vehicle relative to the position of the center of gravity G2 of the outside handle 120, and in a case where the impact load is transmitted from the front side of the vehicle door 10, the outside handle 120 may move to the outer side Z2 of the vehicle before the inertia lever 141 moves by the inertia force. On the other hand, in a case where the center of gravity G1 of the inertia lever 141 is positioned at the front side of the vehicle relative to the position of the center of gravity G2 of the outside handle 120, and in a case where the impact load is transmitted from the rear side of the vehicle door 10, the outside handle 120 may move to the outer side Z2 of the vehicle before the inertia lever 141 moves by the inertia force. Thus, the aforementioned first setting of the center of gravity can solve these issues. Even in a case where the impact load is transmitted from any directions of the vehicle front-rear directions X1 to the vehicle door 10, the inertia lever 141 can be operated by the inertia force without delaying from the movement of the outside handle 120.

The impact load applied to the vehicle when the vehicle receives an impact may be transmitted to the vehicle door 10 from the lower side of the vehicle in the vehicle upper-lower directions Y1, Y2. In this case, in a case where the center of gravity G1 of the inertia lever 141 is positioned at the upper side of the vehicle relative to the position of the center of gravity G2 of the outside handle 120, the outside handle 120 may move to the outer side Z2 of the vehicle before the inertia lever 141 moves by the inertia force when the impact load transmitted from the lower side of the vehicle is applied to the vehicle door 10. Thus, the aforementioned second setting of the center of gravity can solve these issues. Even in a case where the impact load is transmitted to the vehicle door 10 from the lower side of the vehicle, the inertia lever 141 can be operated by the inertia force without delaying from the movement of the outside handle 120.

Alternatively, according to a modified example of the second setting of the center of gravity, the position of the center of gravity G1 of the inertia lever 141 may be set lower than the center of gravity G2 of the outside handle 120. In this setting, the inertia lever 141 can be operated before the outside handle 120 moves when the vehicle receives an impact.

Accordingly, according to the door handle structure including the first center of gravity setting and the second center of gravity setting, the inertia lever 141 can be securely engaged with the engagement portion 134*a* of the connection shaft 134 by operating appropriately when the vehicle receives an impact.

This disclosure is not limited to the aforementioned typical embodiment, and various applications and modifications are available. For example, following embodiments adapting the aforementioned embodiment are available.

According to the aforementioned embodiment, the first arm portion 143 of the inertia lever 141 includes the two engagement pieces 145, 146. Alternatively, the engagement piece 145 including a fixation prevention mechanism of the inertia lever 141 can be excluded as required.

According to the aforementioned embodiment, the counterweight 148 and the plate spring 149 are provided at the extending end range of the second arm portion 144 of the inertia lever 141. Alternatively, the counterweight 148 and the plate spring 149 may be provided at a range other than the extending end range of the second arm portion 144.

According to the aforementioned embodiment, the first arm portion 143 of the inertia lever 141 is provided with the engagement pieces 145, 146 (a first element) restricting the movement of the link mechanism 130, and the second arm portion 144 of the inertia lever 141 is provided with the counterweight 148 (a second element) and the retaining mechanism 160 (a third element). Alternatively, each of the first, second and third elements may be provided at appropriate arm portions.

At least one component of the protection cover 113 and the retaining mechanism 160 being provided at the door handle device 100 can be excluded as required.

The essential structure of the aforementioned door handle device 100 can be applied to a vehicle door of a vehicle. For example, the essential structure of the outside handle can be applied to light-left doors for front seats and rear seats of the vehicle, and to a door (a backdoor) provided at the rear portion of the vehicle.

The door handle device for a vehicle (100) includes the base frame (110) being configured to be attached to the door outer panel (11) of the vehicle door (10), the outside handle (120) being mounted on the base frame (110) so as to be oscillated between the door closed position and the door opened position, the outside handle (120) extending along the outer surface of the vehicle body, the link mechanism (130) converting the movement of the outside handle (120) in the door opening direction, the movement oscillating from the door closed position to the door opened position, into a movement releasing a retention of the vehicle door (10) in a closed state; and the door opening prevention mechanism (140) preventing the vehicle door (10) from opening by restricting the movement of the link mechanism (130) and by preventing the movement releasing the retention of the vehicle door (10) in the closed state when the vehicle receives an impact. The door opening prevention mechanism (140) includes the inertia lever (141) being rotatably supported at the base frame (110), the inertia body (the counterweight 148) being mounted to the inertia lever (141), and the elastic member (the coil spring 147) elastically biasing the inertia lever (141) toward the initial position (P1) where the movement of the link mechanism (130) is not restricted by the inertia lever (141). The inertia lever (141) is retained at the initial position (P1) in response to the elastic biasing force of the elastic member (the coil spring 147) in a case where the inertia lever (141) is not applied with the inertia force applied toward the outer side of the vehicle when the vehicle receives an impact. The inertia lever (141) rotates from the initial position (P1) to the restriction position (P2) where the inertia lever (141) restricts the movement of the link mechanism (130) against the elastic biasing force of the elastic member (the coil spring 147) by using the inertia mass of the inertia body (the counterweight 148) in a case where the inertia lever (141) is applied with the inertia force applied toward the outer side of the vehicle when the vehicle receives an impact and in a case where the inertia force is greater than the elastic biasing force of the elastic member (the coil spring 147). The inertia lever (141) includes the center of gravity (G1) of the inertia lever (141) being set at a same position as a position of a center of gravity (G2) of the outside handle (120) in the extending direction of the outside handle (120), the center of gravity (G1) of the inertia lever (141) being set at the same position as the position of the center of gravity (G2) of the outside handle (120) in vehicle upper-lower directions, or being set at the lower position relative to the center of gravity (G2) of the outside handle (120).

According to the aforementioned construction, the inertia lever 141 rotating up to the restriction position P2 can prevent the movement releasing the retention of the vehicle door in the closed state by restricting the movement of the link mechanism 130. As a result, the vehicle door 10 is prevented from being opened. Further, according to the aforementioned construction, the inertia lever 141 can be operated by the inertia force without delaying from the movement of the outside handle 120 in a case where the impact load when the vehicle receives an impact is transmitted to the vehicle door 10 either from the front side or from the rear side of the vehicle. Moreover, in a case where the impact load when the vehicle receives an impact is transmitted to the vehicle door 10 from the lower side of the vehicle, the inertia lever 141 can be operated by the inertia force without delaying from the movement of the outside handle 120. As a result, the door opening prevention mechanism 140 can be appropriately operated.

The inertia lever (141) includes the first arm portion (143) extending from the support shaft portion (142) of the inertia lever (141), the support shaft portion (142) being rotatably supported at the base frame (110), in the rear direction of the vehicle, and the second arm portion (144) extending from the support shaft portion (142) in the front direction of the vehicle, the second arm portion (144) including the inertia body (the counterweight 148) at the extending end range of the second arm portion (144). The link mechanism (130) includes the operation member (the connection shaft 134). In a case where the inertia force is applied toward the outer side of the vehicle when the vehicle receives an impact, the inertia lever (141) rotates from the initial position (P1) to the restriction position (P2) and the first arm portion (143) comes to be positioned on the movement trace (T) of the operation member (the connection shaft 134) to restrict the movement of the operation member (the connection shaft 134).

According to the aforementioned construction, the inertia lever 141 can restrict the movement of the operation member (the connection shaft 134) at the first arm portion 143 when the vehicle receives an impact. In this case, because the inertia body (the counterweight 148) is provided at the extending end range of the second arm portion 144, the inertia lever 141 can be sensitively operated by the inertia force applied when the vehicle receives an impact.

The door handle device (100) for the vehicle further includes the retaining mechanism (160) for retaining the inertia lever (141) at the restriction position (P2), the inertia lever (141) rotating from the initial position (P1) to the restriction position (P2). The retaining mechanism (160) includes the engagement protrusion (112) being protrudingly provided at the base frame (110) so as to face the second arm portion (144) of the inertia lever (141), and the plate spring (149) being provided at the extending end range of the second arm portion (144), the extending end range that is positioned at the front side of the vehicle. In a case where the inertia lever (141) rotates towards the restriction position (P2), the inertia lever (141) is retained at the restriction position (P2) by the plate spring (149), the plate spring (149) passing through the engagement protrusion (112) in a state where the plate spring (149) is pressed against the engagement protrusion (112) and is elastically deformed, the plate spring (149) being retained at the engagement protrusion (112) by returning to an original shape.

According to the aforementioned construction, because the plate spring 149 is provided at the extending end range of the second arm portion 144, the range of the movement of the plate spring 149 can be increased (the operation stroke can be extended) when the inertia lever 141 is operated. As a result, the engagement structure in which the plate spring 149 and the engagement protrusion 112 are easily engaged with each other can be achieved. Because the plate spring 149 is provided at the extending end range of the second arm portion 144, the plate spring 149 does not disturb the movement of the inertia lever 149.

The door handle device (100) for the vehicle further includes the protection cover (140) being attached to the base frame (110) so as to cover the range from the inner side of the vehicle, the range at least including the area from the support shaft portion (142) to the second arm portion (144) of the inertia lever (141).

According to the aforementioned construction, in a state where the inertia lever 141 is provided at the base frame 110, the inertia lever 141 can be prevented from being retained at the restriction position P2 by the retaining mechanism 160 by an assembly person who may press the inertia lever 141 and may rotate the inertia lever 141 to the restriction position P2.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A door handle device for a vehicle comprising:

a base frame being configured to be attached to a door outer panel of a vehicle door;

an outside handle being mounted on the base frame so as to be oscillated between a door closed position and a door opened position, the outside handle extending along an outer surface of a vehicle body in an extending direction of the outside handle and movable in vehicle inner-outer directions towards and away from the door closed position;

a link mechanism converting a movement of the outside handle in a door opening direction, the movement oscillating from the door closed position to the door opened position, into a movement releasing a retention of the vehicle door in a closed state; and a door opening prevention mechanism preventing the vehicle door from opening by restricting a movement of the link mechanism and by preventing the movement releasing the retention of the vehicle door in the closed state when the vehicle receives an impact; wherein the door opening prevention mechanism includes an inertia lever being rotatably supported at the base frame about an axis which extends in vehicle upper-lower directions perpendicular to the extending direction of the outside handle to thereby rotate in a plane defined by the extending direction of the outside handle and the vehicle inner-outer directions, said vehicle inner-outer directions being perpendicular to the extending direction of the outside handle and also perpendicular to the vehicle upper-lower directions;

an inertia body being mounted to the inertia lever; and an elastic member elastically biasing the inertia lever toward an initial position where the movement of the link mechanism is not restricted by the inertia lever;

the inertia lever is retained at the initial position in response to an elastic biasing force of the elastic member in a case where the inertia lever is not applied with an inertia force applied toward an outer side of the vehicle when the vehicle receives an impact;

the inertia lever rotates from the initial position to a restriction position where the inertia lever restricts the movement of the link mechanism against the elastic biasing force of the elastic member by using an inertia mass of the inertia body in a case where the inertia lever is applied with the inertia force applied toward the outer side of the vehicle when the vehicle receives an impact and in a case where the inertia force is greater than the elastic biasing force of the elastic member; and the inertia lever includes a center of gravity of the inertia lever being aligned with a center of gravity of the outside handle in the extending direction of the outside handle, the center of gravity of the inertia lever being aligned with or lower than the center of gravity of the outside handle in the vehicle upper-lower directions wherein the inertia lever includes; a first arm portion extending from a support shaft portion of the inertia lever, the support shaft portion being rotatably supported at the base frame, in a rear direction of the vehicle; and a second arm portion extending from the support shaft portion in a front direction of the vehicle, the second arm portion including the inertia body at an extending end range of the second arm portion; the link mechanism includes an operation member; and in a case where the inertia force is applied toward the outer side of the vehicle when the vehicle receives an impact, the inertia lever rotates from the initial position to the restriction position and the first arm portion comes to be positioned on a movement trace of the operation member to restrict a movement of the operation member;

a retaining mechanism for retaining the inertia lever at the restriction position, the inertia lever rotating from the initial position to the restriction position; wherein the retaining mechanism includes an engagement protrusion being protrudingly provided at the base frame so as to face the second arm portion of the inertia lever; and a plate spring being provided at the extending end range of the second arm portion, the extending end range that is positioned at a front side of the vehicle; and in a case where the inertia lever rotates towards the restriction position, the inertia lever is retained at the restriction position by the plate spring, the plate spring moving into a recess above the engagement protrusion in a state where the plate spring is pressed against the engagement protrusion and is elastically deformed, the plate spring being retained at the engagement protrusion by returning to an original shape.

2. The door handle device for the vehicle according to claim 1, further comprising:

a protection cover being attached to the base frame so as to cover a range from an inner side of the vehicle, the range at least including an area from the support shaft portion to the second arm portion of the inertia lever.

* * * * *